US008240404B2

(12) United States Patent
Hall et al.

(10) Patent No.: US 8,240,404 B2
(45) Date of Patent: Aug. 14, 2012

(54) ROOF BOLT BIT

(76) Inventors: David R. Hall, Provo, UT (US); Ronald B. Crockett, Payson, UT (US); Andrew Gerla, Provo, UT (US)

( * ) Notice: Subject to any disclaimer, the term of this patent is extended or adjusted under 35 U.S.C. 154(b) by 790 days.

(21) Appl. No.: 12/207,701

(22) Filed: Sep. 10, 2008

(65) Prior Publication Data

US 2009/0000828 A1 Jan. 1, 2009

Related U.S. Application Data

(63) Continuation-in-part of application No. 11/774,667, filed on Jul. 9, 2007, now abandoned, which is a continuation-in-part of application No. 11/766,975, filed on Jun. 22, 2007, now Pat. No. 8,122,980, application No. 12/207,701, which is a continuation-in-part of application No. 11/774,227, filed on Jul. 6, 2007, now Pat. No. 7,669,938, which is a continuation-in-part of application No. 11/773,271, filed on Jul. 3, 2007, now Pat. No. 7,997,661, which is a continuation-in-part of application No. 11/766,903, filed on Jun. 22, 2007, which is a continuation-in-part of application No. 11/766,865, filed on Jun. 22, 2007, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, which is a continuation-in-part of application No. 11/463,953, filed on Aug. 11, 2006, now Pat. No. 7,464,993, said application No. 11/766,903 is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770.

(51) Int. Cl.
*E21B 10/43* (2006.01)

(52) U.S. Cl. ..... 175/427; 175/432

(58) Field of Classification Search ..... 175/427, 175/432, 434
See application file for complete search history.

(56) References Cited

U.S. PATENT DOCUMENTS

| | | | |
|---|---|---|---|
| 616,118 | A | 12/1889 | Kunhe |
| 465,103 | A | 12/1891 | Wegner |
| 946,060 | A | 1/1910 | Looker |
| 1,116,154 | A | 11/1914 | Stowers |
| 1,183,630 | A | 5/1916 | Bryson |

(Continued)

*Primary Examiner* — John Kreck
(74) *Attorney, Agent, or Firm* — Philip W. Townsend, III

(57) ABSTRACT

In one aspect of the present invention, a roof bolt drill bit for use in underground mines comprises a bit body with a shank adapted for attachment to a driving mechanism. A working face disposed opposite the shank comprises a plurality of polycrystalline diamond cutting elements. Carbide bolsters are disposed intermediate the plurality of cutting elements and the bit body.

9 Claims, 13 Drawing Sheets

U.S. PATENT DOCUMENTS 1,189,560 A 7/1916 Gondos
1,360,908 A 11/1920 Everson
1,387,733 A 8/1921 Midgett
1,460,671 A 7/1923 Hebsacker
1,544,757 A 7/1925 Hufford
2,169,223 A 8/1931 Christian
1,821,474 A 9/1931 Mercer
1,879,177 A 9/1932 Gault
2,054,255 A 9/1936 Howard
2,064,255 A 12/1936 Garfield
2,218,130 A 10/1940 Court
2,320,136 A 5/1943 Kammerer
2,466,991 A 4/1949 Kammerer
2,540,464 A 2/1951 Stokes
2,544,036 A 3/1951 Kammerer
2,755,071 A 7/1956 Kammerer
2,776,819 A 1/1957 Brown
2,819,043 A 1/1958 Henderson
2,838,284 A 6/1958 Austin
2,894,722 A 7/1959 Buttolph
2,901,223 A 8/1959 Scott
2,963,102 A 12/1960 Smith
3,135,341 A 6/1964 Ritter
3,294,186 A 12/1966 Buell
3,379,264 A 4/1968 Cox
3,429,390 A 2/1969 Bennett
3,493,165 A 2/1970 Schonfeld
3,583,504 A 6/1971 Aalund
3,764,493 A 10/1973 Rosar
3,821,993 A 7/1974 Kniff
3,830,321 A * 8/1974 McKenry et al. ..... 175/332
3,955,635 A 5/1976 skidmore
3,960,223 A 6/1976 Kleine
4,081,042 A 3/1978 Johnson
4,096,917 A 6/1978 Harris
4,106,577 A 8/1978 Summer
4,109,737 A 8/1978 Bovenkerk
4,176,723 A 12/1979 Arceneaux
4,253,533 A 3/1981 Baker
4,280,573 A 7/1981 Sudnishnikov
4,304,312 A 12/1981 Larsson
4,307,786 A 12/1981 Evans
4,397,361 A 8/1983 Langford
4,416,339 A 11/1983 Baker
4,445,580 A 5/1984 Sahley
4,448,269 A 5/1984 Ishikawa
4,499,795 A 2/1985 Radtke
4,531,592 A 7/1985 Hayatdavoudi
4,535,853 A 8/1985 Ippolito
4,538,691 A 9/1985 Dennis
4,566,545 A 1/1986 Story
4,574,895 A 3/1986 Dolezal
4,640,374 A 2/1987 Dennis
4,852,672 A 8/1989 Behrens
4,889,017 A 12/1989 Fuller
4,962,822 A 10/1990 Pascale
4,981,184 A 1/1991 Knowlton
5,009,273 A 4/1991 Grabinski
5,027,914 A 7/1991 Wilson
5,038,873 A 8/1991 Jurgens
5,119,892 A 6/1992 Clegg
5,141,063 A 8/1992 Quesenbury
5,186,268 A 2/1993 Clegg
5,222,566 A 6/1993 Taylor
5,255,749 A 10/1993 Bumpurs
5,265,682 A 11/1993 Russell
5,361,859 A 11/1994 Tibbitts
5,410,303 A 4/1995 Comeau
5,417,292 A 5/1995 Polakoff
5,423,389 A 6/1995 Warren
5,497,843 A * 3/1996 Burns et al. ..... 175/403
5,507,357 A 4/1996 Hult
5,535,839 A 7/1996 Brady
5,560,440 A 10/1996 Tibbitts
5,568,838 A 10/1996 Struthers
5,655,614 A 8/1997 Azar
5,678,644 A 10/1997 Fielder
5,978,644 A 10/1997 Fielder
5,732,784 A 3/1998 Nelson
5,794,728 A 8/1998 Palmberg
5,848,657 A 12/1998 Flood
5,896,938 A 4/1999 Moeny
5,947,215 A 9/1999 Lundell
5,950,743 A 9/1999 Cox
5,957,223 A 9/1999 Doster
5,957,225 A 9/1999 Sinor
5,979,571 A 9/1999 Scott
5,967,247 A 10/1999 Pessier
5,992,547 A 11/1999 Caraway
5,992,548 A 11/1999 Silva
6,021,859 A 2/2000 Tibbitts
6,039,131 A 3/2000 Beaton
6,092,612 A 7/2000 Brady
6,131,675 A 10/2000 Anderson
6,145,606 A 11/2000 Haga
6,150,822 A 11/2000 Hong
6,186,251 B1 2/2001 Butcher
6,193,001 B1 * 2/2001 Eyre et al. ..... 175/432
6,202,761 B1 3/2001 Forney
6,213,226 B1 4/2001 Eppink
6,223,824 B1 5/2001 Moyes
6,241,036 B1 * 6/2001 Lovato et al. ..... 175/432
6,269,893 B1 8/2001 Beaton
6,269,069 B1 10/2001 Lamine
6,332,503 B1 12/2001 Pessier
6,340,064 B2 1/2002 Fielder
6,364,034 B1 4/2002 Schoeffler
6,394,200 B1 5/2002 Watson
6,408,959 B2 6/2002 Bertagnolli
6,427,782 B2 8/2002 Brady
6,439,326 B1 8/2002 Huang
6,474,425 B1 11/2002 Truax
6,484,825 B2 11/2002 Watson
6,484,826 B1 11/2002 Anderson
6,510,906 B1 1/2003 Richert
6,513,606 B1 2/2003 Krueger
6,533,050 B2 3/2003 Molloy
6,594,881 B2 7/2003 Tibbitts
6,601,454 B1 8/2003 Botnan
6,622,803 B2 9/2003 Harvey
6,668,949 B1 12/2003 Rives
6,672,406 B2 1/2004 Beuershausen
6,729,420 B2 5/2004 Mensa-Wilmot
6,732,817 B2 5/2004 Dewey
6,822,579 B2 11/2004 Goswani
6,929,076 B2 8/2005 Fanuel
6,953,096 B2 10/2005 Glenhill
6,966,393 B2 11/2005 Brady
3,301,339 A1 9/2006 Pennebaker
2001/0004946 A1 6/2001 Jensen
2003/0209366 A1 * 11/2003 McAlvain ..... 175/427
2003/0213621 A1 11/2003 Britten
2004/0026983 A1 * 2/2004 McAlvain ..... 299/111
2004/0238221 A1 12/2004 Runia
2004/0256155 A1 12/2004 Kriesels

* cited by examiner

ROOF BOLT BIT

CROSS REFERENCE TO RELATED APPLICATION

This application is a continuation-in-part of U.S. patent application Ser. No. 11/774,667 filed on Jul. 9, 2007 now abandoned which is a continuation-in-part of U.S. patent application Ser. No. 11/766,975 and was filed on Jun. 22, 2007 now U.S. Pat. No. 8,122,980. This application is also a continuation-in-part of U.S. patent application Ser. No. 11/774,227 which was filed on Jul. 6, 2007 now U.S. Pat. No. 7,669,938. U.S. patent application Ser. No. 11/774,227 is a continuation-in-part of U.S. patent application Ser. No. 11/773,271 which was filed on Jul. 3, 2007 now U.S. Pat. No. 7,997,661. U.S. patent application Ser. No. 11/773,271 is a continuation in-part of U.S. patent application Ser. No. 11/766,903 filed on Jun. 22, 2007. U.S. patent application Ser. No. 11/766,903 is a continuation of U.S. patent application Ser. No. 11/766,865 filed on Jun. 22, 2007. U.S. patent application Ser. No. 11/766,865 is a continuation in-part of U.S. patent application Ser. No. 11/742,304 which was filed on Apr. 30, 2007 now U.S. Pat. No. 7,475,948. U.S. patent application Ser. No. 11/742,304 is a continuation of U.S. patent application Ser. No. 11/742,261 which was filed on Apr. 30, 2007 now U.S. Pat. No. 7,469,971. U.S. patent application Ser. No. 11/742,261 is a continuation in-part of U.S. patent application Ser. No. 11/464,008 which was filed on Aug. 11, 2006 now U.S. Pat. No. 7,338,135. U.S. patent application Ser. No. 11/464,008 is a continuation-in-part of U.S. patent application Ser. No. 11/463,998 which was filed on Aug. 11, 2006 now U.S. Pat. No. 7,384,105. U.S. patent application Ser. No. 11/463,998 is a continuation in-part of U.S. patent application Ser. No. 11/463,990 which was filed on Aug. 11, 2006 now U.S. Pat. No. 7,320,505. U.S. patent application Ser. No. 11/463,990 is a continuation in-part of U.S. patent application Ser. No. 11/463,975 which was filed on Aug. 11, 2006 now U.S. Pat. No. 7,445,294. U.S. patent application Ser. No. 11/463,975 is a continuation in-part of U.S. patent application Ser. No. 11/463,962 which was filed on Aug. 11, 2006 now U.S. Pat. No. 7,413,256. U.S. patent application Ser. No. 11/463,962 is a continuation-in-part of U.S. patent application Ser. No. 11/463,953, which was also filed on Aug. 11, 2006 now U.S. Pat. No. 7,464,993. The present application is also a continuation in-part of U.S. patent application Ser. No. 11/695,672 which was filed on Apr. 3, 2007 now U.S. Pat. No. 7,396,086. U.S. patent application Ser. No. 11/695,672 is a continuation-in-part of U.S. patent application Ser. No. 11/686,831 filed on Mar. 15, 2007 now U.S. Pat. No. 7,568,770. All of these applications are herein incorporated by reference for all that they contain.

BACKGROUND OF THE INVENTION

This invention relates to drill bits, more specifically to improvements in drill bits used for drilling in mine roof bolting operations.

Such drill bits are subjected to large torsional and axial forces, high rotational speed, heat, and abrasion. These environmental factors may cause wear on the cutting elements and the bit body. Long bit life is desirable to reduce the machine downtime required to replace the bit and the associated cost. Extending time between bit replacements may reduce the time spent by mine workers in dangerous, unsupported areas. Roof bolt bits have been disclosed in the prior art.

U.S. Pat. No. 5,535,839 to Brady, which is herein incorporated by reference for all that it contains, discloses a rotary drill bit having a head portion with at least two hard surfaced inserts having domed working surfaces and being oppositely oriented to face in the direction of rotation at positive rake angles, and a mounting adapter for removably securing the drill bit to a drilling machine.

U.S. Pat. No. 5,429,199 to Sheirer, which is herein incorporated by reference for all that it contains, discloses a cutting bit useful for cutting various earth strata and the cutting insert, which may be made from a polycrystalline diamond composite, for such a cutting bit. The cutting bit has at least one pocket at the axially forward end thereof which receives its corresponding cutting insert. The cutting insert has at least one exposed cutting edge which is of an arcuate shape.

U.S. Pat. No. 4,550,791 to Isakov, which is herein incorporated by reference for all that it contains, discloses a two-prong rotary drill bit, especially for use with roof drills. The two-prong bit has a supporting body having an axis of rotation. The two-prong bit has a pair of inserts, one insert on each of the prongs. Each of the inserts has a cutting portion facing in the direction of rotation and a mounting portion. When viewed in a direction parallel to the axis of rotation, each of the inserts will have a cross-sectional configuration which is generally wedge-shaped. Also disclosed are wedge-shaped inserts especially for use with roof drill bits.

BRIEF SUMMARY OF THE INVENTION

In one aspect of the present invention, a mining roof bolt bit comprises a bit body intermediate a shank and a working surface, the shank being adapted for attachment to a driving mechanism. The working surface comprises a plurality of polycrystalline diamond enhanced cutting elements. Carbide bolsters are disposed intermediate the cutting elements and the bit body.

The plurality of polycrystalline diamond cutting elements may comprise pointed geometry. The pointed geometry may comprise a thickness of 100 inch or more, and may comprise a radius, preferably between 0.050 inch and 0.200 inch. At least one of the plurality of polycrystalline diamond cutting elements may comprise a central axis intersecting an apex of the pointed geometry, and the central axis may be oriented within a 15 degree rake angle. The working surface may comprise an indenting member disposed substantially coaxial with the rotational axis of the bit. The indenting member may comprise a polycrystalline diamond element disposed on the distal portion of the indenting member. The indenting may depend axially from the bit body less than, equal to, or greater than the cutting elements.

The carbide bolsters may be brazed to the bit body, preferably at a non-planer interface. The carbide bolsters may comprise a substantially conical portion, and may comprise a flat. The flats may be brazed together, and the bolsters may also comprise geometry adapted to interlock with one or more other carbide bolsters. The bolsters may comprise a cavity, and an end of a shaft may be interlocked in the cavity. An opposite end of the shaft may be adapted to be attached to the bit body by threads or other methods.

The carbide bolsters may comprise a substantially straight cylindrical portion at least mostly disposed below the surface of the bit body, a top end and a bottom end, the top end narrowing from the cylindrical portion with a substantially annular concave curve to a planer interface adapted for bonding to a carbide substrate, and the bottom end narrowing from the cylindrical portion to a stem.

In some embodiments, the bit may be adapted for use with a driving mechanism comprising a hammer mechanism adapted to oscillate the bit axially.

The bit may comprise vacuum ports in communication with a vacuum source in the driving mechanism to provide vacuum to the working surface of the bit. In some embodiments of the present invention, the bolsters are press fit into the bit body. In some embodiments, the cutting elements comprise a substantially conical geometry with a rounded apex and a wall of the conical geometry forming an included angle with a central axis of the cutting element of 70 to 90 degrees. The carbide substrates may be less than 10 mm in axial thickness.

DETAILED DESCRIPTION OF THE INVENTION AND THE PREFERRED EMBODIMENT

Figure 1:
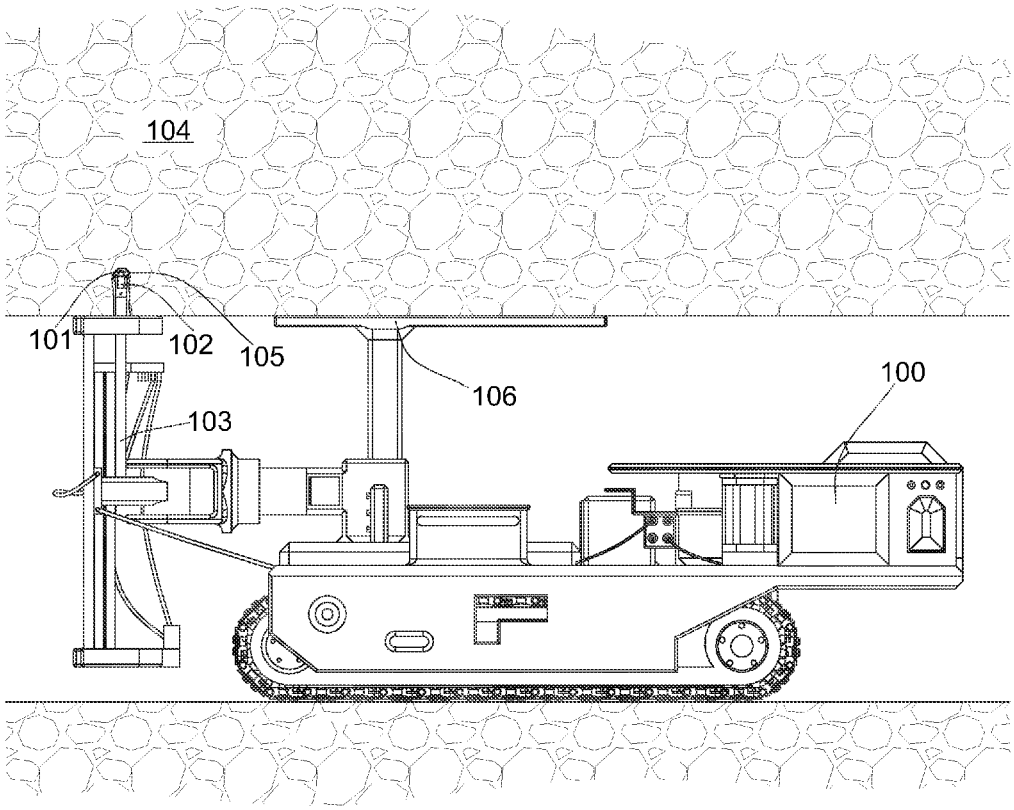
FIG. 1 is an orthogonal view of an embodiment of a roof bolting machine.

FIG. 1 discloses a roof bolt bit 102 attached to a roof bolting machine 100. Roof bolt bit 102 comprises cutting elements 101. The roof bolt bit 102 is attached to a driving mechanism such as a rotating drive shaft 103. Drive shaft 103 may be rotatable by an electric motor, hydraulic motor or other method. Drive shaft 103 may be adapted to apply axial force in the direction of drilling to advance the bit 102 in the formation 104. Axial force may be applied by mechanical, hydraulic, or other methods. Cutting elements 101 may engage the formation 104 as the bit 102 rotates to create a borehole 105 to a desired depth. Roof bolting machine 100 may be adapted to provide temporary roof support 106 during the drilling operation. The roof bolting machine 100 may be adapted to supply fluid and/or vacuum through the drive shaft 103 to the roof bolt bit 102. The roof bolting machine may be adapted to transport debris to a conveyor or other apparatus to remove the debris from the mine. The roof bolting machine may be adapted to install roof bolts in the bore after the drilling is complete.

Figure 2:
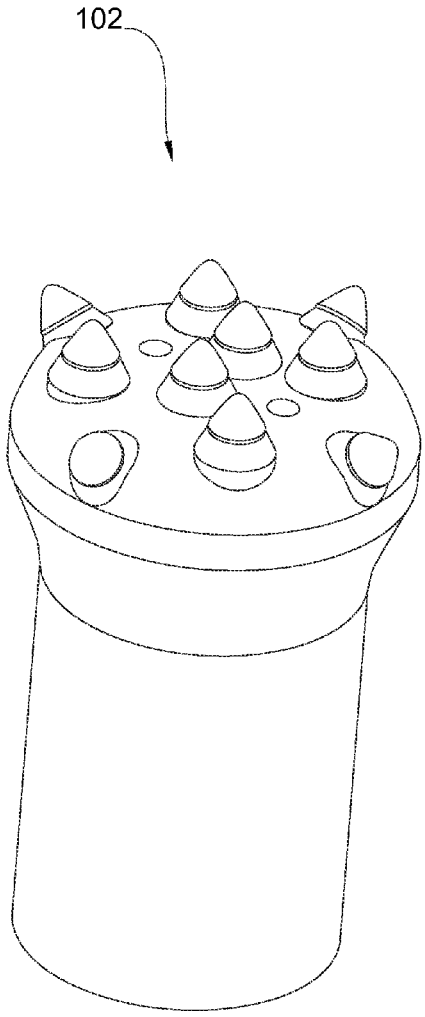
FIG. 2 is a perspective view of an embodiment of a roof bolt bit.

FIG. 2 discloses a roof bolt bit 102. In this embodiment, roof bolt bit 102 is adapted for use with a driving mechanism comprising a hammer mechanism adapted to oscillate the bit axially against the formation. Cyclic axial forces applied through the bit may cause the formation to fail under compressive load. This may degrade the formation more quickly than the shear forces developed by bit rotation alone.

Figure 3:
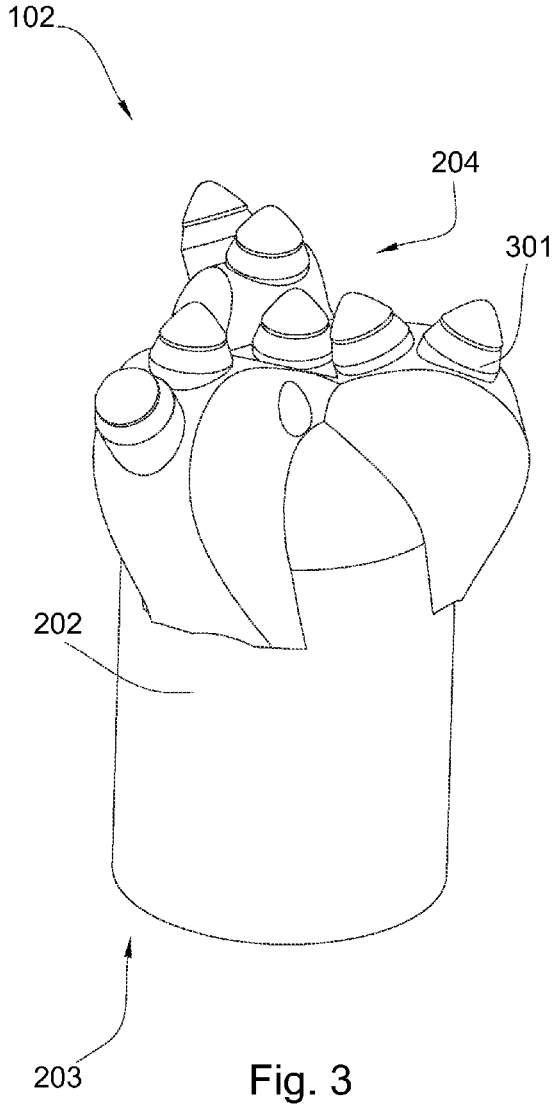
FIG. 3 is a perspective view of another embodiment of a roof bolt bit.

FIG. 3 discloses a roof bolt bit 102. Roof bolt bit 102 comprises a bit body 202 disposed intermediate a shank 203 and a working surface 204. A plurality of carbide bolsters 301 are disposed intermediate the working surface and the bit body. Carbide is a hard, wear resistant material, and may be more resistant to wear than the material the bit body 202 is constructed of. Accordingly, the bit body may wear much more quickly than the carbide bolsters when the bit is in use. The bit body may comprise hard facing in areas susceptible to abrasive wear. Hard facing may be applied by welding, brazing, furnace brazing, plasma deposition, or other methods.

Figure 4:
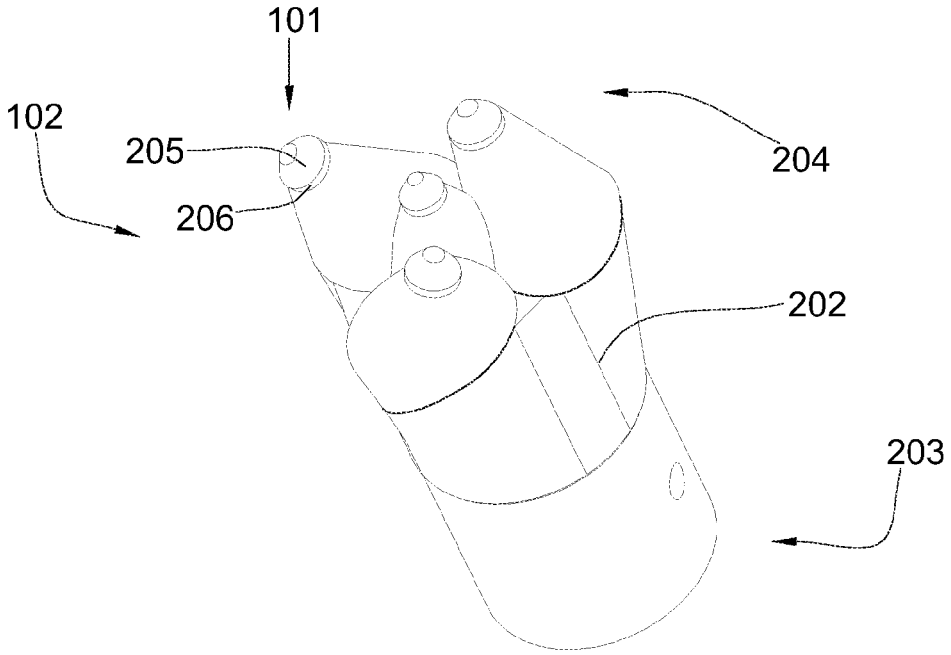
FIG. 4 is a perspective view of another embodiment of a roof bolt bit.

FIG. 4 discloses a roof bolt bit 102 according to the present invention. The roof bolt bit 102 comprises a bit body 202 disposed intermediate a shank 203 and a working surface 204. The shank 203 may be adapted to be attached to a driving mechanism by threads, a splined interface, a roll pin, hex drive, square drive, or other method. The bit body may be constructed from steel, a steel/carbide matrix, or other material with the desired characteristics by casting, forging, sintering, machining, or combinations thereof. The bit body may be case hardened, in which process the metal is heated in a carbon, boron, and/or nitrogen rich environment. These elements diffuse into the surface metal, increasing the hardness and wear resistance. The bit body may be heat treated.

The working surface 204 comprises a plurality of cutting elements 101. Cutting elements 101 may comprise a polycrystalline diamond portion 205 bonded to a carbide substrate 206. The bond interface may be nonplaner. The polycrystalline diamond may comprise substantially conical geometry, and may comprise a thickness of 0.100 inch or greater. The polycrystalline diamond may comprise an apex opposite the carbide substrate with a radius of 0.050 inches to 0.200 inches. The carbide substrate 206 may be less than 10 millimeters thick axially. The volume of the polycrystalline diamond may be 75% to 150% of the volume of the carbide substrate, preferably between 100% and 150% of the volume of the carbide substrate. The polycrystalline diamond and carbide substrate may be processed together in a high-pressure, high-temperature press.

Figure 5:
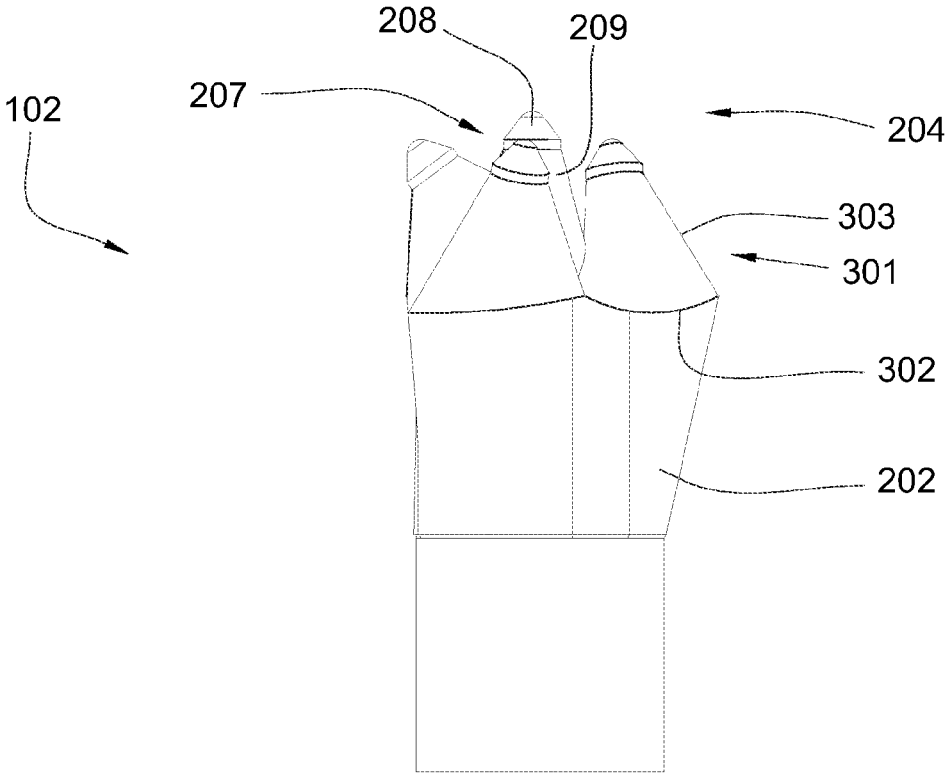
FIG. 5 is an orthogonal view of another embodiment of a roof bolt bit.

FIG. 5 discloses a roof bolt bit 102 according to the present invention. Carbide bolsters 301 are disposed intermediate the bit body 202 and the working surface 204. Carbide bolsters 301 may comprise a substantially conical portion 303. The substantially conical portion 303 allows for a large surface area at an interface 302 with the bit body 202, providing better distribution of load for increased stiffness and strength. The interface 302 between the bit body 202 and the carbide bolster 301 may be adapted to withstand the shear loads, axial compressive loads, and tensile loads that may be present while the bit is in use. The interface 302 between the bit body 202 and the carbide bolsters 301 may comprise substantially nonplaner, substantially conical, or other geometry. The carbide bolsters 301 may be brazed or otherwise bonded to the bit body 202 at the interface 302.

An indenting member 207 may be disposed substantially coaxial with the rotational axis of the bit. The indenting member may stabilize the bit, reducing bit whirl and vibration, thus producing a straighter bore with a more consistent diameter. Lessening vibration may also extend the life of the bit and associated hardware. The indenting member may also reduce axial loading on the cutting elements, increasing their service life. The indenting member may comprise a polycrystalline diamond tip 208 or other hard insert. A carbide segment 209 may be disposed intermediate the hard insert tip and the bit body. The hard insert tip may be brazed or otherwise bonded to the carbide segment, and the carbide segment 209 may be brazed or otherwise bonded to the bit body. The indenting member may extend axially beyond the cutting elements, or extend axially equal to or less than the cutting elements.

Figure 6:
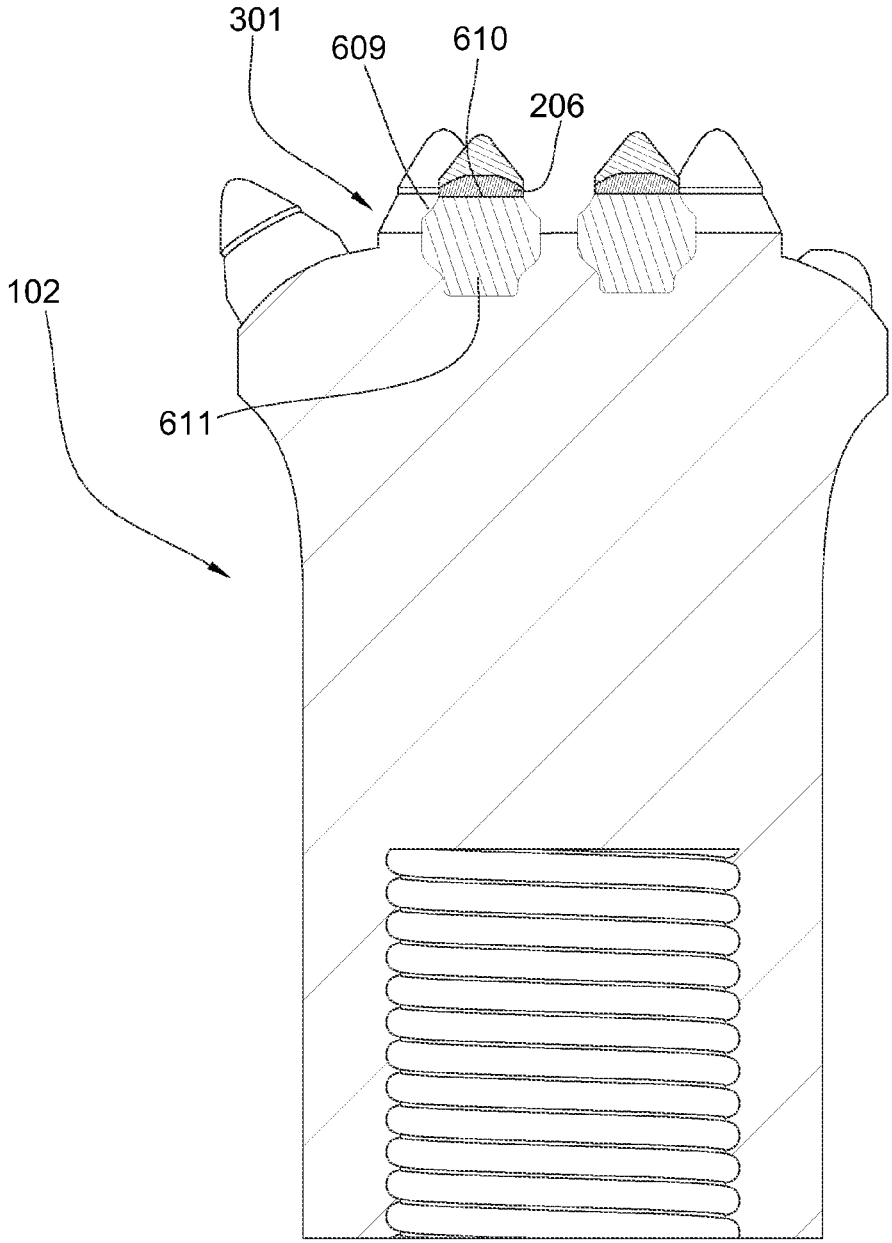
FIG. 6 is a cross-sectional view of another embodiment of a roof bolt bit.

FIG. 6 discloses a roof bolt bit according to the present invention. Roof bolt bit 102 comprises a plurality of carbide bolsters 301 disposed intermediate the bit body 202 and the working surface 204. Carbide bolsters 301 may comprise a generally cylindrical portion with a top and a bottom end. The top end may narrow from the cylindrical portion with a substantially annular concave curve 609 to a planer interface 610 adapted to be bonded to a carbide substrate 206. The bottom end may narrow from the cylindrical portion to a stem 611. The stem 611 may enhance the stability of the carbide bolster. Carbide bolster 301 may be attached to the bit body 202 by brazing, an interference fit, or other method. In some embodiments, the bolsters may be press fit into the bit body.

Figure 7:
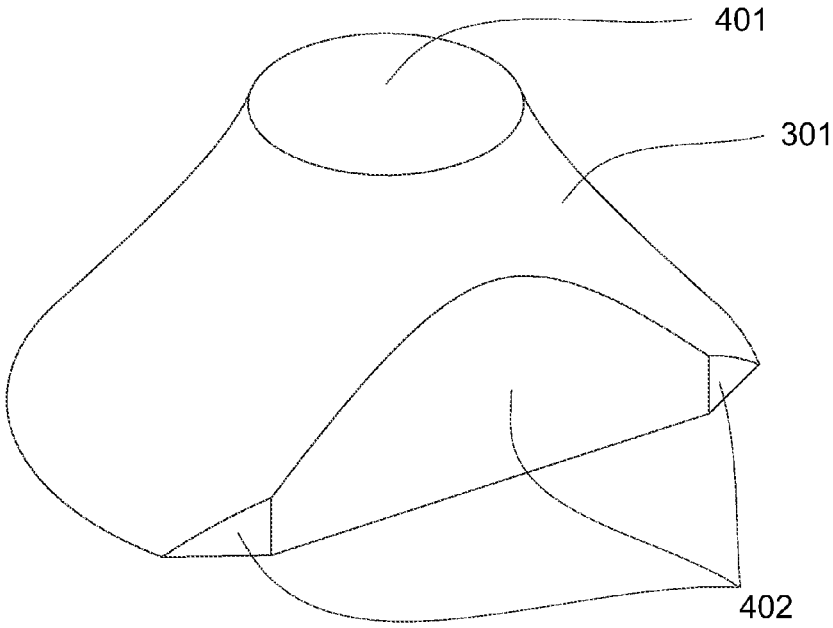
FIG. 7 is a perspective view of an embodiment of a carbide bolster.

FIG. 7 discloses an embodiment of a carbide bolster 301. Carbide bolster 301 comprises a surface 401 onto which cutting elements may be brazed or otherwise affixed. The carbide bolster 301 may also comprise a plurality of flats 402 located on the periphery of the base of the bolster. Flats 402 allow the bolsters to fit substantially together and against the indenting member, leaving little if any of the face of the bit body exposed. This structure may protect the bit body from abrasion and wear and extend the usable life of the bit.

Figure 8:
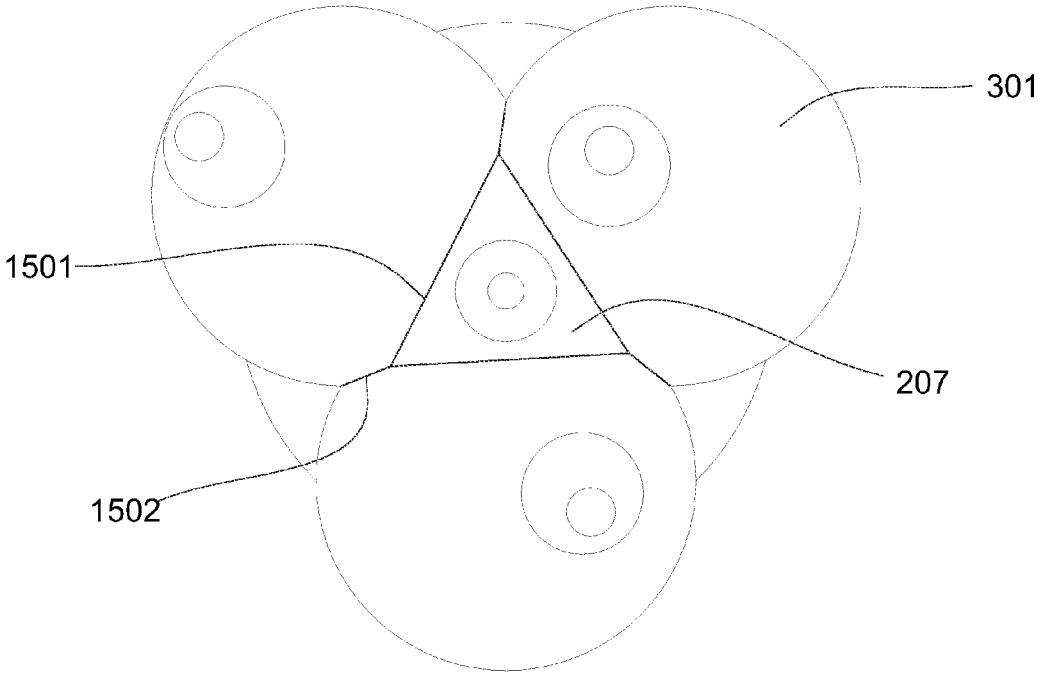
FIG. 8 is an orthogonal view of another embodiment of a roof bolt bit.

FIG. 8 discloses a roof bolt bit. Carbide bolsters 301 are disposed substantially adjacent indenting member 207. An interface 501 may be disposed intermediate each of the carbide bolsters and the indenting member 207. Interface 501 may comprise a braze joint. An interface 502 may be disposed intermediate a carbide bolster 301 and an adjacent carbide bolster. Interface 502 may comprise a braze joint. This structure may increase the stiffness and strength of the working face. Brazing the carbide bolsters together may protect the bit body from abrasion and wear.

Each of the plurality of cutting elements 101 may be disposed a different radial distance from the rotational axis of the bit body. This allows each cutting element to follow a separate cutting path and engage the formation around a different circumference. The outermost cutting element may be oriented such that it defines the gauge, or diameter, of the borehole.

Figure 9:
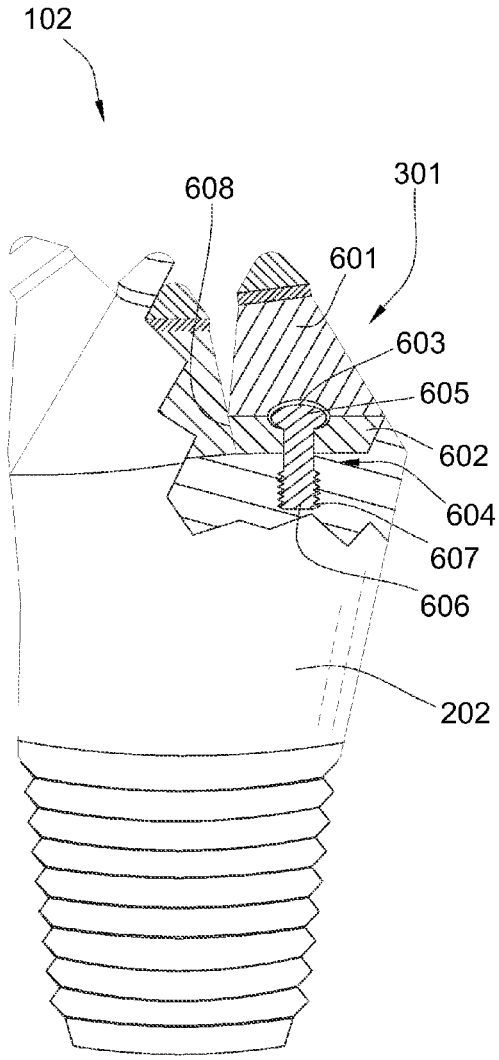
FIG. 9 is a cross-sectional view of another embodiment of a roof bolt bit.

FIG. 9 discloses another embodiment of a roof bolt bit 102. In this embodiment, carbide bolster 301 comprises a carbide upper segment 601 and a carbide lower segment 602. Carbide upper segment 601 may be brazed or otherwise bonded to carbide lower segment 602. Upper segment 601 and lower segment 602 may form at least part of a cavity 603. An end 605 of a shaft 604 may be interlocked in the cavity, and an opposite end 606 may be adapted to be attached to the bit body by threads 607 or other method. Lower carbide segment 602 may comprise a tapered portion 608 adapted to retain the indenting member 207 to the bit body 202 when the carbide bolster 301 is installed on the bit body.

Figure 10:
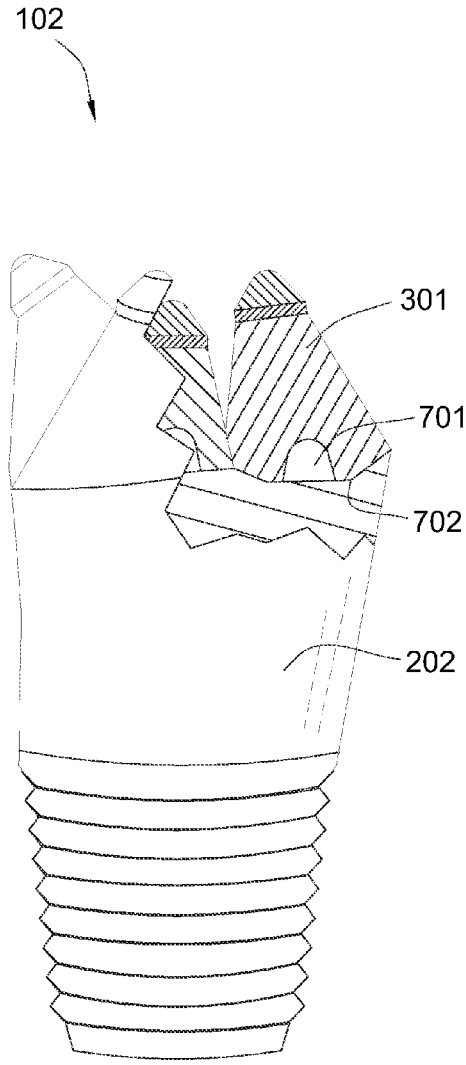
FIG. 10 is a cross-sectional view of another embodiment of a roof bolt bit.

FIG. 10 discloses another embodiment of a roof bolt bit 102. In this embodiment, a carbide bolster 301 comprises a recess 701 at an interface 702 with the bit body 202. Carbide bolster 301 may be brazed to the bit body 202 at the interface 702. Interface 702 may comprise nonplaner and/or substantially conical geometry. Residual stresses may be created during the brazing process due to the differing coefficients of thermal expansion of steel and carbide, and the recess 701 may alleviate those residual stresses.

Figure 11A:
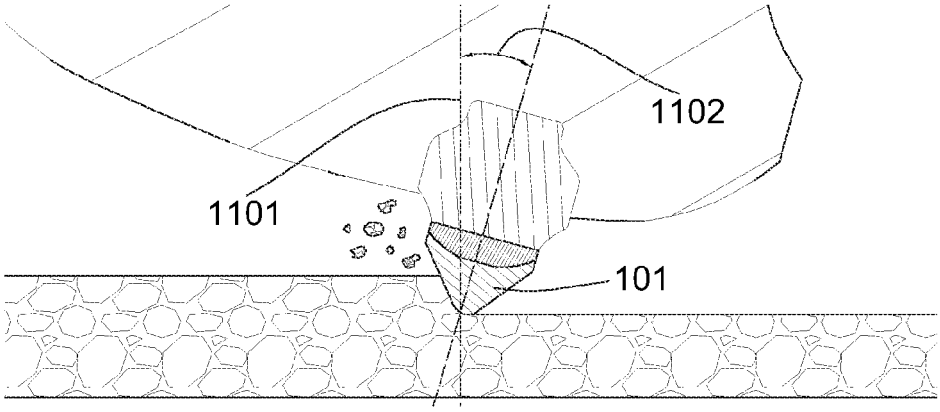
FIG. 11*a* is a cross-sectional view of an embodiment of a cutting element.
Figure 11B:
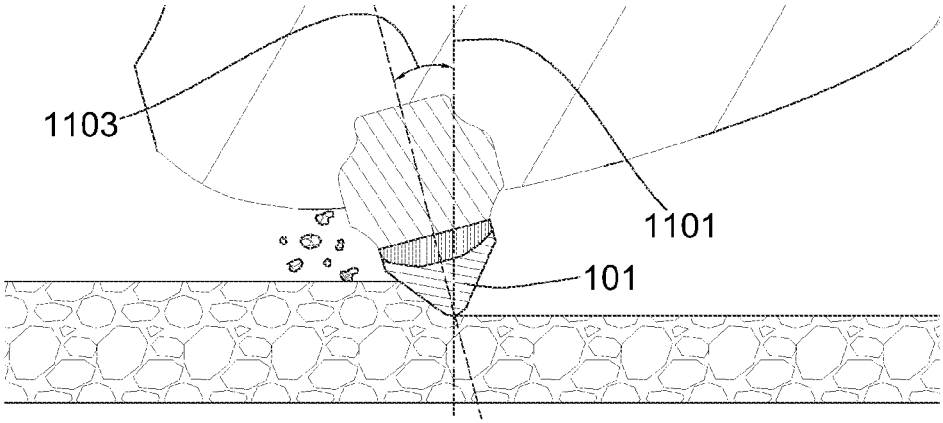
FIG. 11*b* is a cross-sectional view of another embodiment of a cutting element.
Figure 11C:
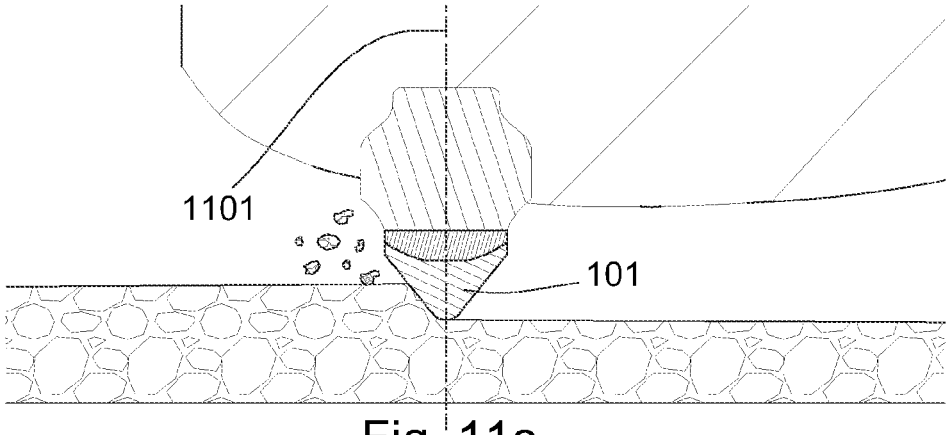
FIG. 11*c* is a cross-sectional view of another embodiment of a cutting element.

FIGS. 11*a*-11*c* disclose a polycrystalline diamond cutting element 101 in contact with a formation 104 wherein a central axis 1101 is oriented within a 15 degree rake angle. FIG. 11*a* discloses a positive rake angle 1102 within 15 degrees, FIG. 11*b* discloses a negative rake angle 1103 within 15 degrees, and FIG. 11*c* discloses a zero rake angle. Rake angle may be from positive 15 degrees to approaching zero degrees, negative 15 degrees to approaching zero degrees, or zero degrees.

Figure 12:
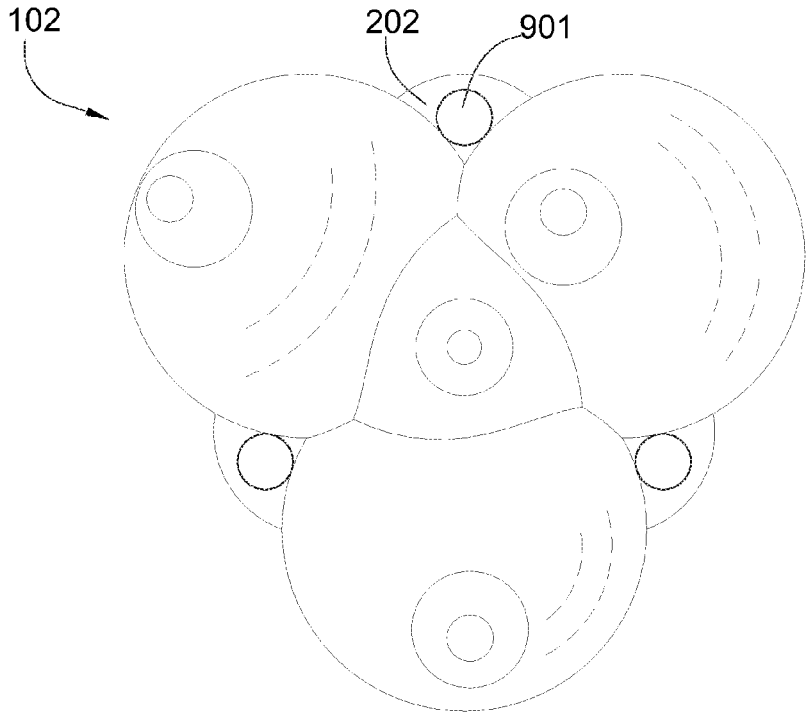
FIG. 12 is an orthogonal view of another embodiment of a roof bolt bit.

FIG. 12 discloses another embodiment of a roof bolt bit 102. Vacuum and/or fluid ports 901 are disposed in the bit body 202 to remove dust and debris from the working face. Vacuum passages may be disposed in the bit body and be in communication with the vacuum ports 901 and a vacuum source in the driving mechanism. Removal of debris by vacuum may reduce breathable dust and create a safer environment for the mine workers. Dust and debris may be stored in a compartment on the roof bolting machine or transported out of the mine by a conveyor or other method.

Figure 13:
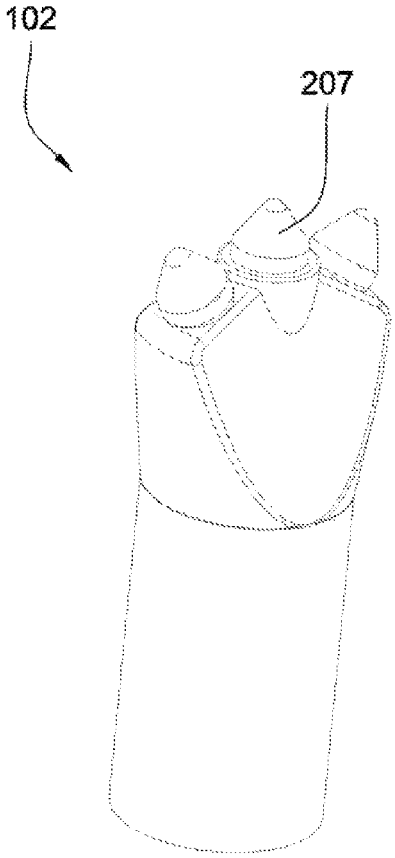
FIG. 13 is a perspective view of another embodiment of a roof bolt bit.
Figure 13A:
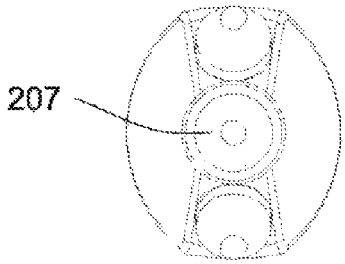
FIG. 13*a* is an orthogonal view of another embodiment of a roof bolt bit.

FIG. 13 discloses another embodiment of a roof bolt bit 102. Roof bolt bit 102 comprises an indenting member 207. The indenting member 207 may be disposed substantially coaxial with the rotational axis of the bit 102, as disclosed in FIG. 13*a*.

Figure 14:
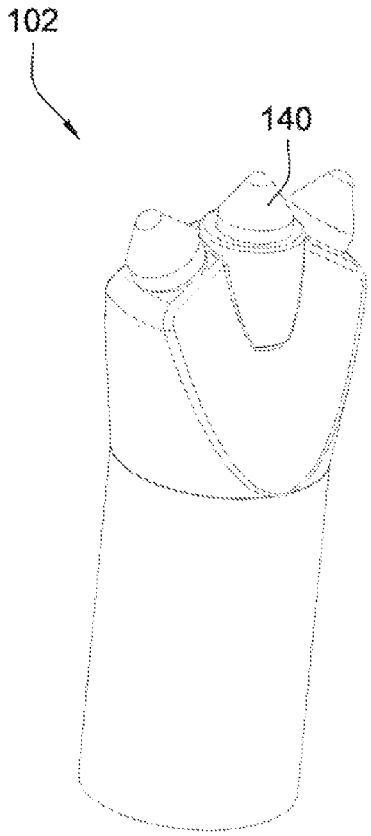
FIG. 14 is a perspective view of another embodiment of a roof bolt bit.
Figure 14A:
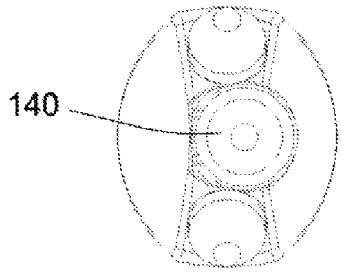
FIG. 14*a* is an orthogonal view of another embodiment of a roof bolt bit.

FIG. 14 discloses another embodiment of a roof bolt bit 102. Roof bolt bit 102 comprises at least one cutting element 140 disposed substantially bi-center from the rotational axis of the bit 102, as disclosed in FIG. 14*a*.

Figure 15:
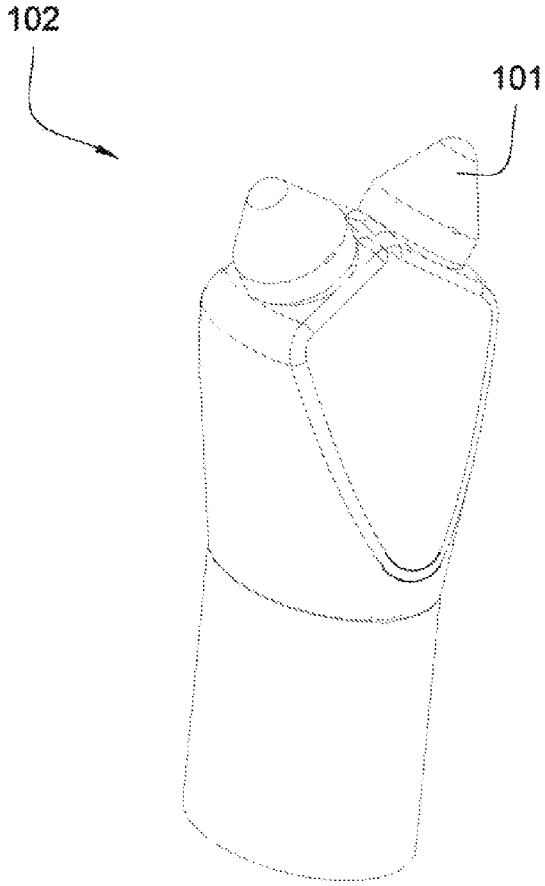
FIG. 15 is a perspective view of another embodiment of a roof bolt bit.

FIG. 15 discloses another embodiment of a roof bolt bit 102. Roof bolt bit 102 comprises at least one cutting element 101 disposed substantially on the distal end of the roof bolt bit 102.

Whereas the present invention has been described in particular relation to the drawings attached hereto, it should be understood that other and further modifications apart from those shown or suggested herein, may be made within the scope and spirit of the present invention.

The pointed cutting elements are believed to increase the ratio of formation removed upon each rotation of the drill bit to the amount of diamond worn off of the cutting element per rotation of the drill bit over the traditional flat shearing cutters of the prior art, Generally the traditional flat shearing cutters of the prior art will remove 0.010 inch per rotation of a Sierra White Granite wheel on a VTL, test with 4200-4700 pounds loaded to the shearing element with the granite wheel. The granite removed with the traditional flat shearing cutter is generally in a powder form. With the same parameters, the pointed cutting elements with a 0.150 thick diamond and with a 0.090 to 0.100 inch radius apex positioned substantially at a zero rake removed over 0.200 inches per rotation in the form of chunks.

Figure 16B:
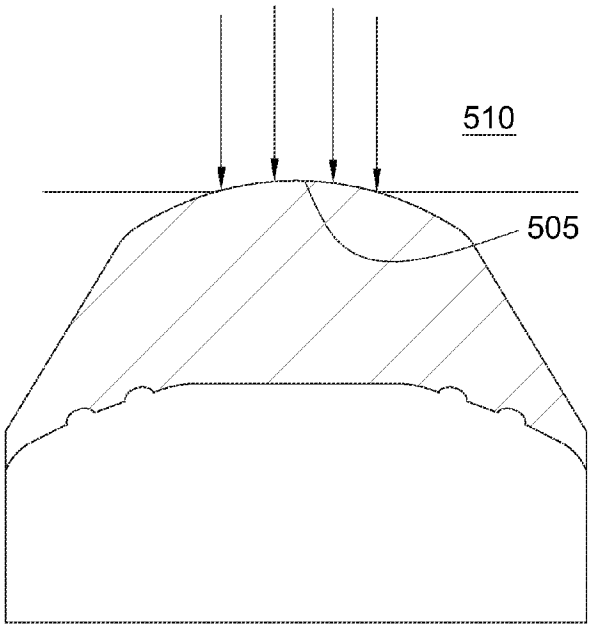
FIG. 16*b* is a cross-sectional diagram of another embodiment of a cutting element.
Figure 16:
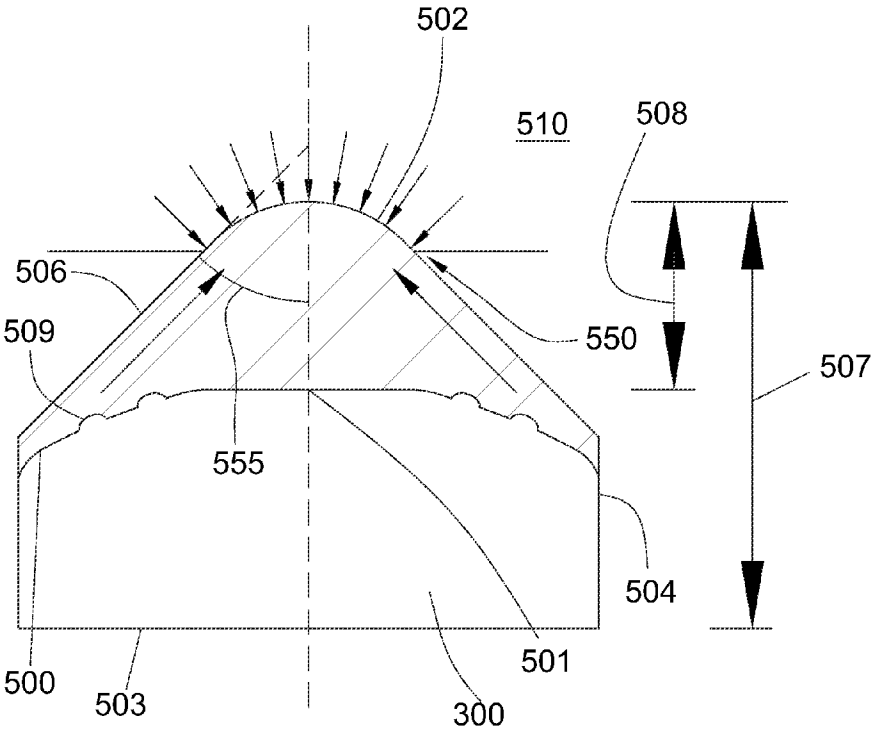
FIG. 16 is a cross-sectional diagram of an embodiment of a cutting element.

Comparing FIGS. 16 and 16*b*, the advantages of having a pointed apex 502 as opposed to a blunt apex 505 may be seen. FIG. 16 is a representation of a pointed geometry which was made by the inventors of the present invention, which has a 0.094 inch radius apex and a 0.150 inch. thickness from the apex to the non-planar interface. FIG. 16*b* is a representation of another geometry also made by the same inventors comprising a 0.160 inch radius apex and 0.200 inch thickness from the apex to the non-planar geometry. The cutting elements were compared to each other in a drop test performed at Novatek International, Inc. located in Provo, Utah. Using an Instron Dynatup 9250G drop test machine, the cutting elements were secured in a recess in the base of the machine burying the substrate portions of the cutting elements and leaving the diamond working ends 506 exposed. The base of the machine was reinforced from beneath with a solid steel pillar to make the structure more rigid so that most of the impact force was felt in the diamond working end 506 rather than being dampened. The target 510 comprising tungsten carbide 16% cobalt grade mounted in steel backed by a 19 kilogram weight was raised to the needed height required to generate the desired potential force, then dropped normally onto the cutting element. Each cutting element was tested at a starting 5 joules, if the elements withstood joules they were retested with a new carbide target 510 at an increased increment of 10 joules the cutting element failed. The pointed apex 502 of FIG. 16 surprisingly required about 5 times more joules to break than the thicker geometry of FIG. 16*b*.

It is believed that the sharper geometry of FIG. 16 penetrated deeper into the tungsten. carbide target 510, thereby allowing more surface area of the diamond working ends 506 to absorb the energy from the falling target by beneficially buttressing the penetrated portion of the diamond working ends 506 effectively converting bending and shear loading of the substrate into a more beneficial compressive force drastically increasing the load carrying capabilities of the diamond working ends 506. On the other hand it is believed that since the embodiment of FIG. 16*b* is blunter the apex hardly penetrated into the tungsten carbide target 510 thereby providing little buttress support to the substrate and caused the diamond working ends 506 to fail in shear/bending at a much lower load with larger surface area using the same grade of diamond and carbide. The average embodiment of FIG. 16 broke at about 130 joules while the average geometry of FIG., 16*b* broke at about 24 joules. It is believed that since the load was distributed across a greater surface area in the embodiment of FIG. 16 it was capable of withstanding a greater impact than that of the thicker embodiment of FIG. 16*b*.

Surprisingly, in the embodiment of FIG. 16, when the super hard geometry finally broke, the crack initiation point 550 was below the radius of the apex. This is believed to result from the tungsten carbide target 510 pressurizing the flanks of the pointed geometry 700 (number not shown in the fig.) in the penetrated portion, which results in the greater hydrostatic stress loading in the pointed geometry. It is also believed that since the radius was still intact after the break, that the pointed geometry will still be able to withstand high amounts of impact, thereby prolonging the useful life of the pointed geometry even after chipping.

Figure 16A:
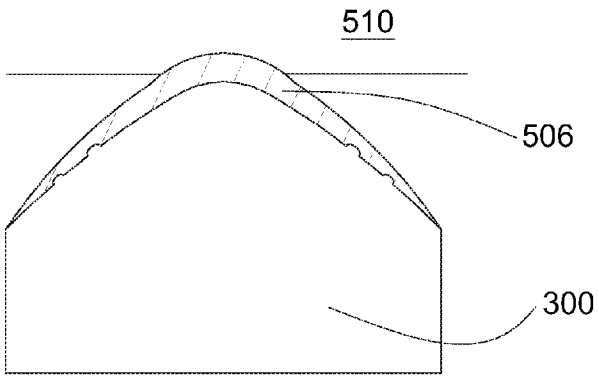
FIG. 16*a* is a cross-sectional diagram of another embodiment of a cutting element.
Figure 17:
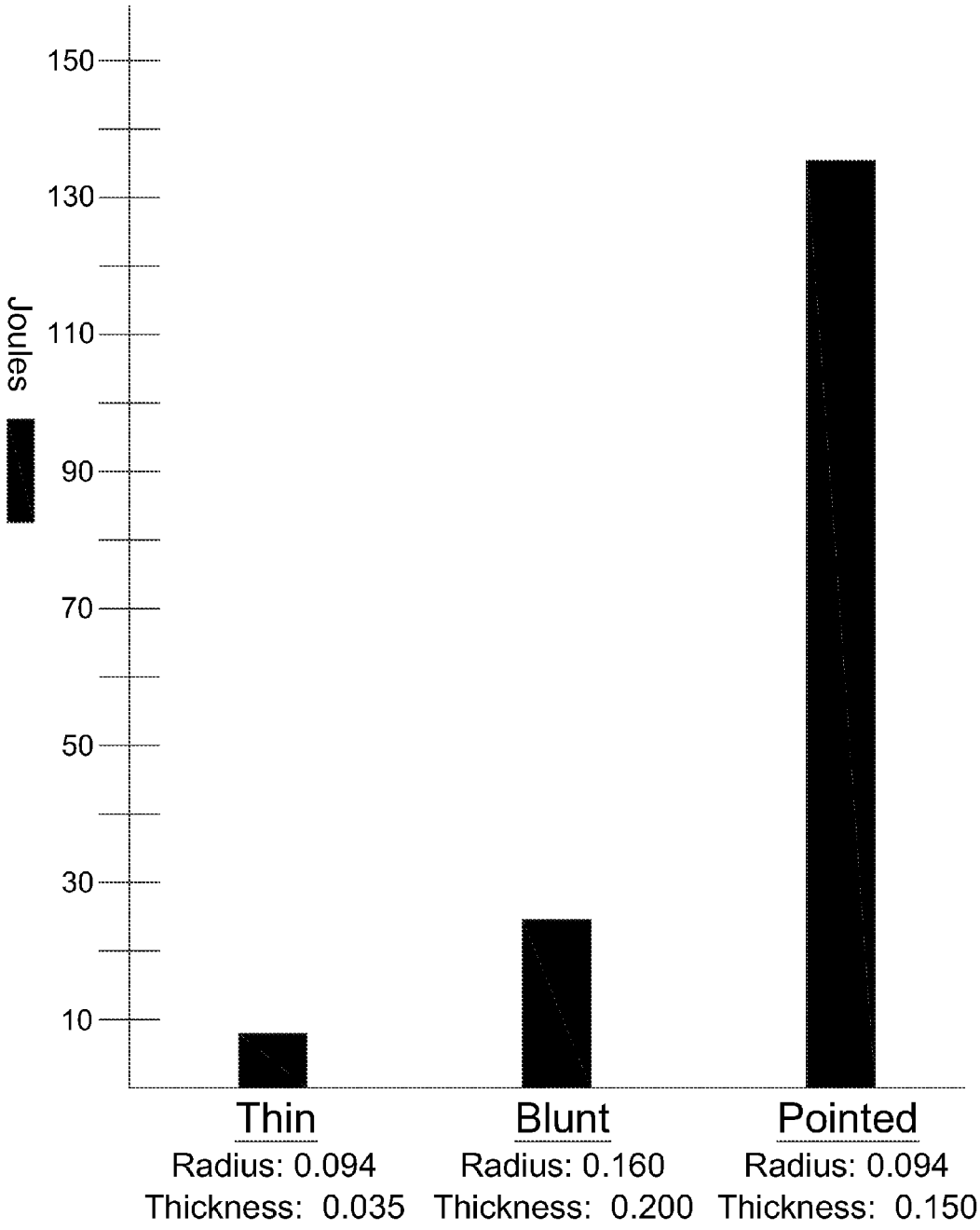
FIG. 17 is a diagram of an embodiment of test results.

FIG. 17 illustrates the results of the tests performed by Novatek, International, Inc. As can be seen, three different types of pointed insert geometries were tested. This first type of geometry is disclosed in FIG. 16*a* which comprises a 0.035 inch super hard geometry and an apex with a 0.094 inch radius. This type of geometry broke in the 8 to 15 joules range. The blunt geometry with the radius of 0.160 inches and a thickness of 0.200, which the inventors believed would outperform the other geometries broke, in the 20-25 joule range. The pointed geometry 700 with the 0.094 thickness and the 0.150 inch thickness broke at about 130 joules. The impact force measured when the super hard geometry with the 0.160 inch radius broke was 75 kilo-newtons. Although the Instron drop test machine was only calibrated to measure up to 88 kilo-newtons, which the pointed geometry 700 exceeded when it broke, the inventors were able to extrapolate that the pointed geometry 700 probably experienced about 105 kilo-newtons when it broke.

As can be seen, super hard material 506 having the feature of being thicker than 0.100 inches or having the feature of a 0.075 to 0.125 inch radius is not enough to achieve the diamond working end's 506 optimal impact resistance, but it is synergistic to combine these two features. In the prior art, it was believed that a sharp radius of 0.075 to 0.125 inches of a super hard material such as diamond would break if the apex were too sharp, thus rounded and semi spherical geometries are commercially used today.

The performance of the present invention is not presently found in commercially available products or in the prior art. Inserts tested between 5 and 20 joules have been acceptable in most commercial applications, but not suitable for drilling very hard rock formations.

What is claimed is:

1. A rotary mine roof drilling bit, comprising:

a bit body intermediate a shank and a working surface, the shank being adapted for attachment to a driving mechanism;

the working surface comprising a plurality of polycrystalline diamond enhanced cutting elements comprising a carbide substrate bonded to the diamond at a non-planar interface;

carbide bolsters disposed intermediate the bit body and the plurality of cutting elements; and at least one of the plurality of the cutting elements comprises a pointed geometry that comprises a 0.050 to 0.125 inch radius and a thickness greater than 0.100 inches;

wherein the carbide bolsters comprise a substantially straight cylindrical portion at least mostly disposed below the surface of the bit body, a top end and a bottom end, the top end narrowing from the cylindrical portion with a substantially annular concave curve to a planar interface adapted for bonding to a carbide substrate, and the bottom end narrowing from the cylindrical portion to a stem.

2. The bit of claim 1, wherein the bit is adapted for use with a driving mechanism comprising a hammer mechanism adapted to oscillate the bit axially.

3. The bit of claim 1, wherein the carbide bolsters are brazed to the bit body at an interface with a non-planar geometry.

4. The bit of claim 3, wherein the carbide bolsters comprise a recess at the interface that is configured to relieve residual stresses resulting from different thermal expansions of the carbide bolsters and the bit body during a brazing process.

5. The bit of claim 1, wherein at least one cutting element comprises a central axis intersecting an apex of the pointed geometry, the central axis being oriented within a 15 degree rake angle.

6. The bit of claim 1, wherein the cutting elements comprise a substantially conical geometry with a rounded apex and a wall of the conical geometry forming an included angle with a central axis of the cutting element of 70 to 90 degrees.

7. The bit of claim 1, wherein the carbide substrate is less than 10 mm in axial thickness.

8. The bit of claim 1, wherein the carbide bolsters comprise a substantially conical portion.

9. A rotary mine roof drilling bit, comprising:

a bit body intermediate a shank and a working surface, the shank being adapted for attachment to a driving mechanism;

the working surface comprising a plurality of polycrystalline diamond enhanced cutting elements comprising a carbide substrate bonded to the diamond at a non-planar interface;

carbide bolsters disposed intermediate the bit body and the plurality of cutting elements; and at least one of the plurality of the cutting elements comprises a pointed geometry that comprises a 0.050 to 0.125 inch radius and a thickness greater than 0.100 inches;

wherein the carbide bolsters are press fit into the bit body.

* * * * *